US008439192B2

(12) United States Patent
Goto et al.

(10) Patent No.: US 8,439,192 B2
(45) Date of Patent: May 14, 2013

(54) TOOLBOX

(75) Inventors: Munetoshi Goto, Anjo (JP); Kiyozumi Kokawa, Anjo (JP); Toru Horiyama, Anjo (JP); Yoshizo Hasegawa, Anjo (JP)

(73) Assignee: Makita Corporation, Anjo (JP)

( * ) Notice: Subject to any disclaimer, the term of this patent is extended or adjusted under 35 U.S.C. 154(b) by 56 days.

(21) Appl. No.: 12/385,360

(22) Filed: Apr. 6, 2009

(65) Prior Publication Data

US 2009/0250365 A1 Oct. 8, 2009

(30) Foreign Application Priority Data

Apr. 8, 2008 (JP) ..... 2008-100311

(51) Int. Cl.
*A45C 11/00* (2006.01)

(52) U.S. Cl.
USPC ..... 206/349; 206/372; 206/373; 320/111; 320/114

(58) Field of Classification Search ..... 206/349, 206/372, 373; 320/111, 114
See application file for complete search history.

(56) References Cited

U.S. PATENT DOCUMENTS

| | | | | |
|---|---|---|---|---|
| 6,571,949 | B2 * | 6/2003 | Burrus et al. | 206/373 |
| 7,456,609 | B2 * | 11/2008 | Fuchs | 320/114 |
| 2002/0104709 | A1 | 8/2002 | Hines | |
| 2006/0260964 | A1 | 11/2006 | Feldmann et al. | |
| 2008/0164842 | A1 * | 7/2008 | Bergner | 320/111 |

FOREIGN PATENT DOCUMENTS

| | | | |
|---|---|---|---|
| DE | 10 2004 060 294 | A1 | 6/2006 |
| DE | 10 2006 000 939 | A1 | 7/2007 |
| EP | 1 285 732 | A1 | 2/2003 |
| JP | A-62-19183 | | 1/1987 |
| JP | A-05-039879 | | 2/1993 |
| JP | B2-3916962 | | 5/2007 |
| WO | WO 2007/071128 | A1 | 6/2007 |

* cited by examiner

*Primary Examiner* — Steven A. Reynolds
*Assistant Examiner* — King M Chu
(74) *Attorney, Agent, or Firm* — Oliff & Berridge, PLC

(57) ABSTRACT

A toolbox is configured to store at least one hand-held tool in a forward leaning position. A front end portion of a tool main body and a rear end potion of a handle are supported by a seat portion of the toolbox.

16 Claims, 3 Drawing Sheets

TOOLBOX

This application claims priority to Japanese patent application serial number 2008-100311, the contents of which are incorporated herein by reference.

BACKGROUND OF THE INVENTION

1. Field of the Invention

The present invention relates to boxes (toolboxes) for storing hand-held tools, such as an electric driver.

2. Description of the Related Art

A toolbox includes a toolbox main body for storing hand-held tools, battery packs to be attached to the electric tools, and battery chargers, and a lid for opening and closing the toolbox main body. In general, a carrying handle is formed with the toolbox.

Japanese Laid-Open Patent Publication No. 2003-236772 (Japanese Patent No. 391692) teaches a technique for storing a rechargeable tool and a removable battery pack without causing bumping. Japanese Laid-Open Utility Model Publication No. 62-19183 discloses a toolbox for storing an electric circular saw and also teaches a technique for compactly storing a circular saw main body and a removable blade. Japanese Laid-Open Utility Model Publication No. 5-39879 teaches a technique for storing tools in various shapes and sizes.

However, these conventional toolboxes have been intended for storing tools after completion of work and for not using repeatedly or frequently bringing the tools in and out during the working process. The conventional toolboxes have been constructed to store the tools in a horizontal laying manner and thus, when the tools are temporarily stored within the toolboxes during the working process, users have to re-grip the tools to change from a horizontal laying position to a working position. Due to this, the conventional toolboxes have been inconvenient to use.

Thus, there is a need in the art for a multifunctional toolbox which can store the tools after completion of work and can serve as a tool keeping keeper or enabling to frequently bring in or out, and to temporally store the tools during the working process.

SUMMARY OF THE INVENTION

One aspect according to the present invention includes a toolbox for storing at least one hand-held tool having a tool main body and a handle portion extending from a side portion of the tool main body. The toolbox is constructed to be able to store the hand-held tool in a forward leaning position in which a front end portion of the tool main body and a rear end portion of the handle portion are supported by the toolbox.

DETAILED DESCRIPTION OF THE INVENTION

Each of the additional features and teachings disclosed above and below may be utilized separately or in conjunction with other features and teachings to provide improved toolboxes. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Figure 1:
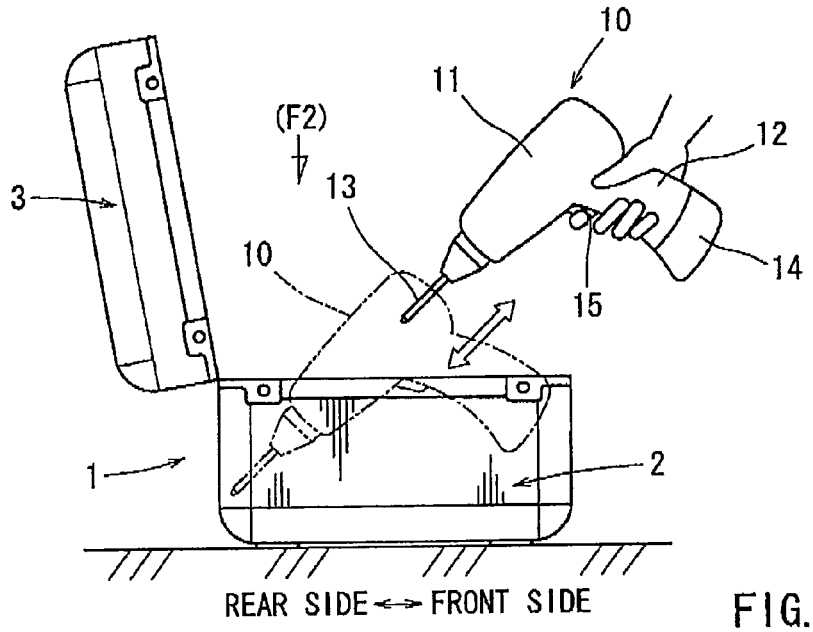
FIG. 1 is an overall lateral view showing a toolbox in an embodiment. The figure shows the electric tool stored and out.
Figure 2:
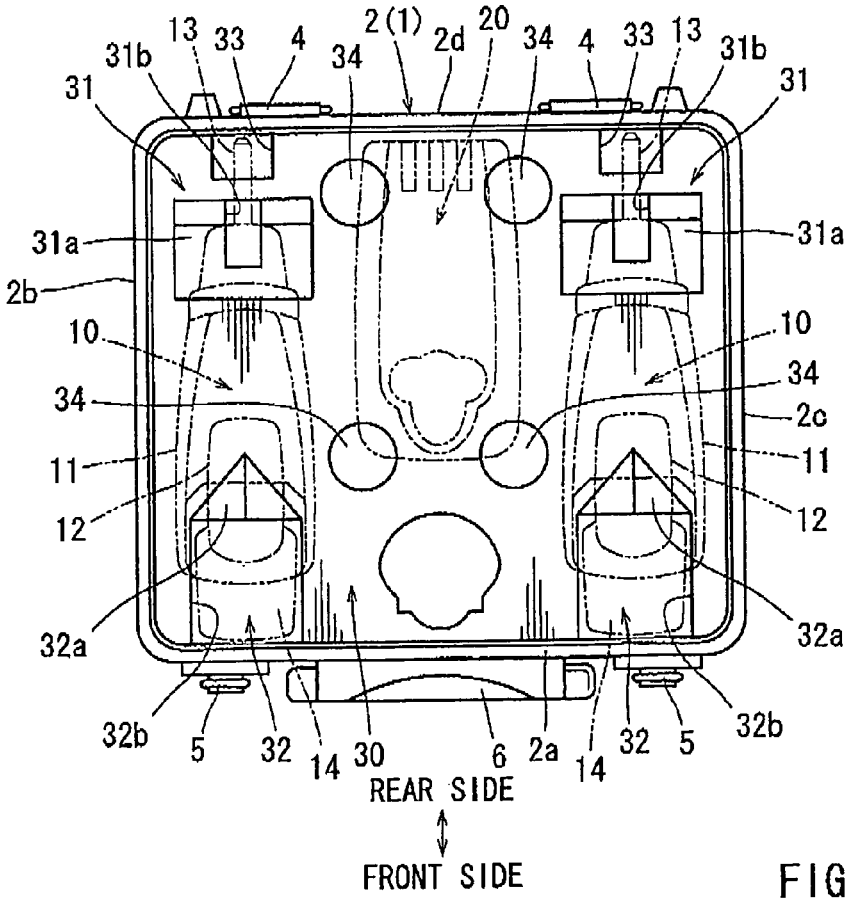
FIG. 2 is a plan view showing the toolbox when the toolbox main body is viewed from a direction of an arrow (F2) in FIG. 1. The figure also shows two electric tools and a battery pack in dashed two dotted lines. An opened lid is omitted in the figure.
Figure 3:
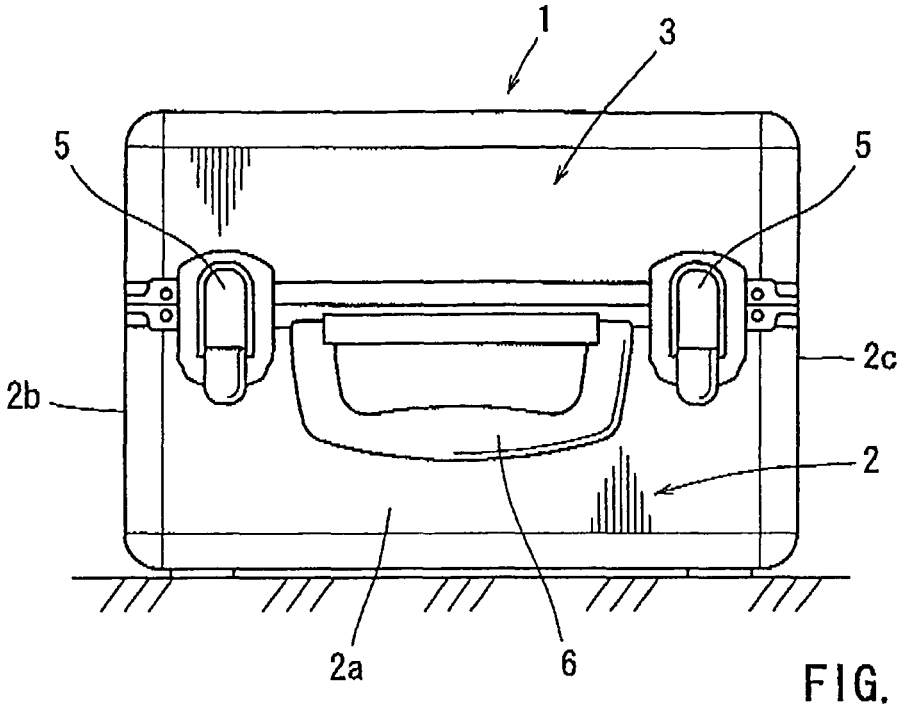
FIG. 3 is a front elevation view showing the toolbox when the lid is closed.

An Embodiment of the present invention will be explained with reference to FIG. 1-FIG. 7. FIG. 1-FIG. 3 show an overall view of a toolbox 1 according to the embodiment. The toolbox 1 has a toolbox main body 2 and a lid 3 for opening and closing the toolbox main body 2. Both the toolbox main body 2 and the lid 3 can be made of aluminum. As shown in FIG. 1, a user may be positioned on the right side of the toolbox 1. In the following description, a side where the user is positioned is described as a front side, and the opposite side is described as a back side or a rear side.

The toolbox main body 2 has a substantially square box shape having a sufficient depth and an opening on the top. The toolbox main body 2 has a front wall portion 2*a* on the user's side, a left side wall portion 2*b* on the user's left side, a right side wall portion 2*c* on the user's right side, a rear wall portion 2*d* on the back side the front wall portion 2*a*, and a bottom portion (this portion is hidden by a seat portion 30 in FIG. 2). The lid 3 is supported via a pair of right and left hinge portions 4 on the upper part of the rear wall portion 2*d* so that the lid 3 can be open or closed in up and down directions. The lid 3 is locked in the closed state with a pair of right and left locks 5 mounted on the front side of the lid 3. A handle 6 is formed on the upper part of the front wall portion 2*a* of the toolbox main body 2. The user grips the handle 6 to carry toolbox 1.

Figure 4:
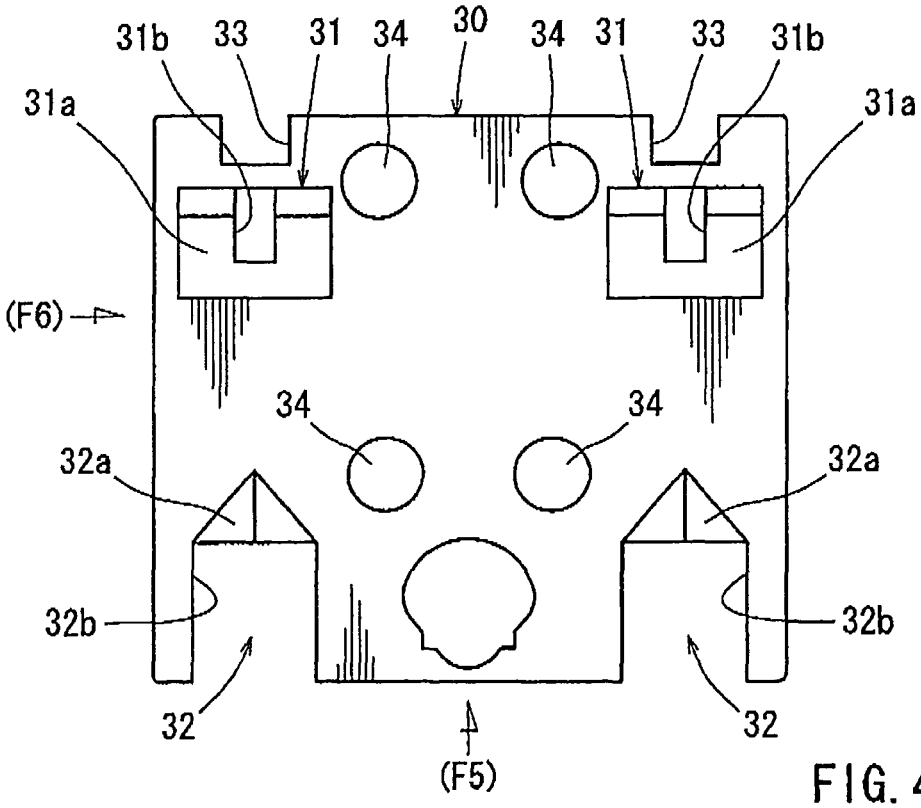
FIG. 4 is a plan view showing a seat portion.
Figure 5:
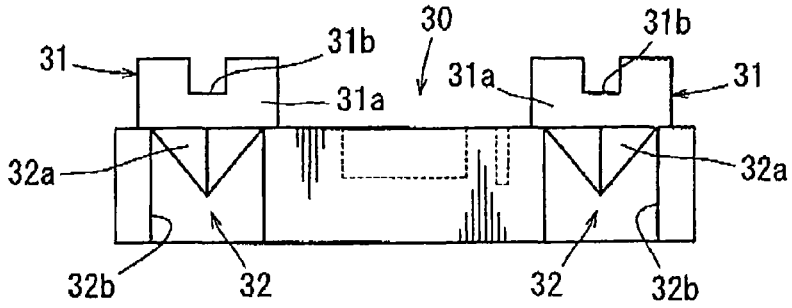
FIG. 5 is a front elevation view showing the seat portion viewed from a direction of an arrow (F5) in FIG. 4.
Figure 6:
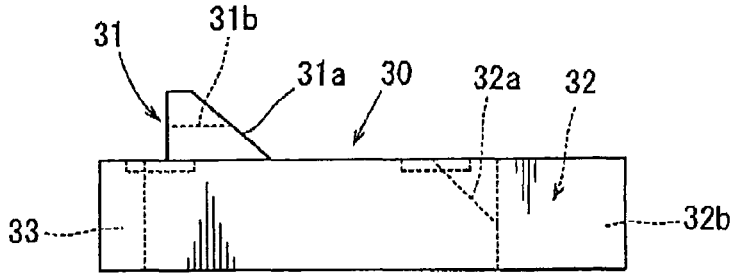
FIG. 6 is a side elevation view showing the seat portion viewed from a direction of an arrow (F6) in FIG. 4.

As shown in FIG. 2, the seat portion 30 can be made of foamed urethane having an adequate cushioning property and placed inside the toolbox main body 2. FIG. 4-FIG. 6 show the seat portion 30. Two electric tools 10 and a battery charger 20 can be positioned on the seat portion 30. The toolbox 1 of this embodiment is characterized mainly in the seated position of the two electric tools 10.

In this embodiment, the two storable electric tools 10 can be hand-held electric drivers each having a tool main body 11 in a substantially cylindrical column shape and a handle portion 12 extending laterally from the tool main body 11. A tool bit 13, such as a driver bit, is attached to a front end of the tool main body 11. A battery pack 14 is attached to a rear end portion of the handle portion 12. A trigger type switch lever 15, which can be pushed by a users fingertips, is formed on the base portion of the handle portion 12. When the switch lever 15 is triggered, an electric motor disposed within the tool main body 11 starts by receiving the supply of power from the battery pack 14, and the tool bit starts rotating.

The user holds the electric tool 10 by griping the handle portion 12 with the side of the front end portion (the side of the tool bit 13) of the tool main body 11 oriented forwardly, and in this state, the user pushes the switch lever 15 for performing a boring operation, etc.

As shown in FIG. 1, the user is positioned on the right side of the toolbox 1 (the front side of the toolbox 1) and brings in or out the electric tool 10 from a position obliquely upward as shown with an outlined arrow in FIG. 1. This allows the user to bring the electric tool 10 from the front side of the toolbox 1 into the toolbox main body 2 while keeping the same position as the working position and without changing the gripping position of the electric tool 10 to another position. Thus, the electric tool 10 can be stored in a standing and forward leaning position.

As shown in FIG. 2, the two electric tools 10 can be stored in parallel on right and left sides of the battery charger 20. The battery charger 20 can have a rectangle box shape. The battery charger 20 is stored at a position between the two electric tools 10 which are stored in the parallel manner on right and left sides of the toolbox main body 2. The electric tools 10 are stored in a forward leaning position such that the directions along their lengths (longitudinal directions) of the both electric tools 10 are oriented along the open or close direction of the lid 3.

Figure 7:
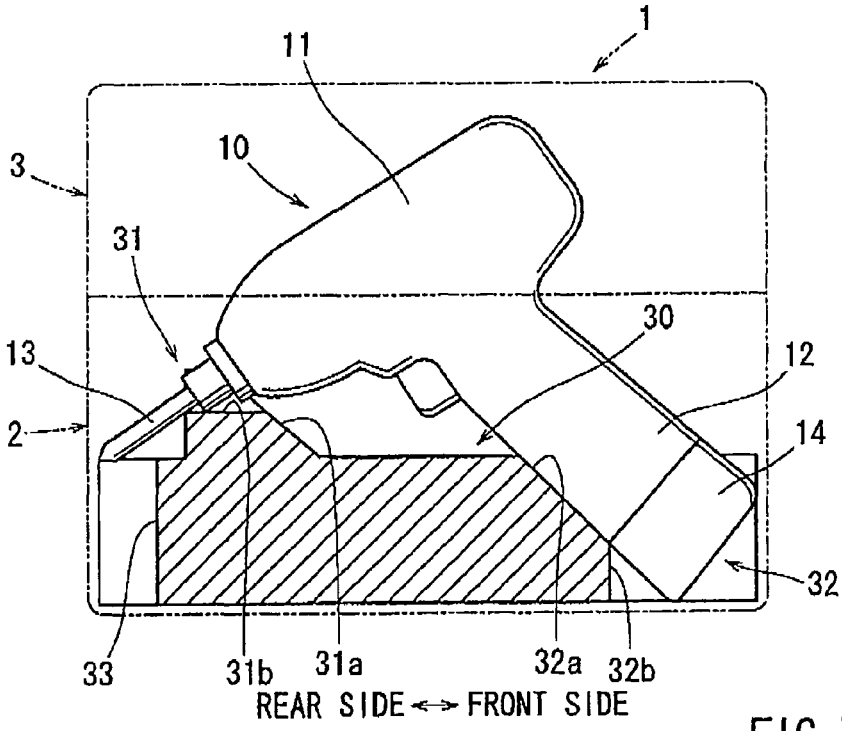
FIG. 7 is a side elevation view showing a tool stored on the seat portion in a forward leaning manner. In the figure, the seat portion is shown in a longitudinal cross sectional view and a toolbox main body and the lid are shown in dashed two dotted lines.

Specifically, each of the front end portion of the tool main body 11 and the rear end portion of the handle portion 12 (i.e., the battery pack 14) of each of the electric tools 10 is supported by the seat portion 30, so that each of the electric tools 10 is stored in a position that the rear portion of the tool main body 11 extends obliquely upward from the seat portion 30 (the forward leaning position). Accordingly, the front end portion of the tool main body 11 is supported on the rear side portion of the toolbox main body 2, the rear end portion of the handle portion 12 is supported on the front side portion, so that each of the electric tools 10 is stored in the forward leaning standing position which is substantially same with the position that is taken when the user grips the electric tool 10 during the working process (a working position). FIG. 7 shows one of the electric tools 10 being supported on the seat portion 30 in the forward leaning position.

A pair of front end supporting portions 31 disposed on the right and left sides for supporting the main bodies 11 of the electric tools 10 and a pair of rear end supporting portions 32 disposed on the right and left sides for supporting the rear ends of the handle portions 12 are respectively (i.e. integrally) formed on the upper surface of the seat portion 30. On the right and left sides of the upper surface of the seat portion 30, the electric tools 10 are respectively supported in a standing position to extend between the front end supporting portions 31 and the rear end supporting portions 32.

As shown in FIGS. 4-7, each of the front end supporting portions 31 is formed in a raising manner from the upper surface of the seat portion 30, and has a supporting surface 31*a* inclining upwardly towards the rear side and a fitting concave portion 31*b* for fitting with the front end portion of the tool main body 11. The inclined supporting surfaces 31*a* is configured to contact the front end portion of the tool main body 11, and the fitting concave portion 31*b* is configured to accommodate a spindle of the electric tool 10.

The rear end supporting portions 32 are positioned at the front end portion of the seat portion 30 on the front side of the front end supporting portions 31. Each of the rear end supporting portions 32 has a V-shaped supporting recess 32*a* inclining deeper towards the front side and a fitting concave portion 32*b* for fitting mainly with the battery pack 14. As shown in FIG. 7, the handle portion 12 is fitted into the handle supporting recess 32*a* and the battery pack 14 is placed inside the fitting concave portion 32*b*.

In this way, each of the front end portions (spindles) of the tool main bodies 11 is fitted into corresponding one of the fitting concaves 31*b* of the front end supporting portions 31 of the toolbox main body 11, and each of the rear end portions of the handle portions 12 (the battery packs 14) is fitted into corresponding one of the handle supporting recesses 32*a*. Accordingly, each of the electric tools 11 is supported in the forward leaning position without falling off asides.

Cutting tool relieving concaves 33 are formed at the rear end part of the seat portion 30 (left end portion in FIG. 7) on the front end supporting portions 31 for mainly receiving the front ends of the tool bits 13 of the stored electric tools 10.

As shown in FIG. 2, supporting holes 34 are formed in the center of the upper surface of the seat portion 30. The supporting holes 34 can receive four legs (not shown of the battery charger 20) for preventing the movement of the battery charger 20 in the lateral direction (a direction parallel to the upper surface of the seat portion 30). In this embodiment, each of the supporting holes is formed to be shallow and to have a comparatively larger diameter in order to be compatible with battery chargers in various sizes.

According to the toolbox 1 of this embodiment described above, the electric tools 10 each having the handle portion 12 extending laterally from the tool main body 11 (which has a substantially cylindrical configuration) can be stored in a forward leaning position that is slightly leaned forwardly compared to a usual working position. In the forward leaning position, each of the rear portion of the tool main bodies 11 (the end portions toward the side of the user) is kept at a higher position than the tool bit 13. In addition, each of the base portions of the handles 12 is kept at a higher position than the battery pack 14. In this way, each of the handle portions 12 is positioned on the side of the user and in the forward leaning position. Due to this, each of the handle portions 12 is easily gripped. Accordingly, the user can smoothly and easily bring the electric tools 10 into and out of the toolbox main body 2.

Whereas, the known electric tool in this kind has been stored in a horizontally lying position that is, for instance, the same with the position that the electric tool is laid on a flat working table. Because the electric tool has been fitted into a seat portion in the lying position, it has been troublesome to bring the electric tool out by gripping the handle.

According to the embodiment of the present invention, the electric tools 10 can be stored in a forward leaning position while their handle portions 12 are positioned to be opposed to the user. Therefore, the user can store the electric tools 10 in substantially the same position as the working position. When the electric tool(s) 10 is needed, the user can quickly and easily grip the handle portion 12, withdraw it at an oblique upward direction, and start the working operation in the same position without need of re-gripping the electric tool 10.

In this way, because the user can store the electric hand tool 10 by gripping the same maintaining the usual working position, the user can also utilize the toolbox 1 as a tool keeper for temporarily storing the electric tool(s) 10 during a machining operation, such as a boring operation.

As the electric tool(s) 10 is stored in the forward leaning position, the user who may be positioned on the front side of the toolbox 1 can store the electric tool(s) 10 by moving it in an obliquely downward direction and can bring out the electric tool(s) by moving it in an opposite direction. Therefore, the user can store or bring out the electric tool(s) 10 while he or she takes a comfortable posture without need of further bending and stretching his or her arms.

In the embodiment the two electric tools 10 are stored in parallel on right and left sides of the battery charger 20 for the battery pack 14 of the electric tools 10 and are spaced from each other by a suitable distance. Due to this, the electric tools 10 and the battery charger 20 do not interfere with each other when they are brought in or out from the toolbox 1. In addition, the user gripping one of the electric tools 10 can quickly and easily bring in and out one of the electric tools 10 because the hand of the user may not contact the other electric tool 10.

The electric tools 10 are not stored in a simply upright position on the upper surface of the seat portion 30 but in the forward leaning position inclining the front end portion of the tool main body 11 downward. Therefore, the electric tools 10 can be stored to have a height smaller than the height in the upright position.

Various changes can be made to the above explained embodiment. For instance, electric drivers are exemplified as tools to be stored in the toolbox described in the above embodiment. Electric screwdrivers and other electric tools can also be stored in the toolbox. Furthermore, the toolbox can store electric tools that receive the supply of power from an AC power source, other than the electric tools having battery packs. Moreover, the toolbox can also be used for storing pneumatic tools other than electric tools.

Although the seat portion 30 in the embodiment has an adequate cushion property, the seat portion may be made of metal, hard resin or wood.

The invention claimed is:

1. A toolbox for storing at least one hand-held tool, comprising:

a tool main body and a handle portion extending from a side portion of the tool main body, wherein the toolbox is constructed to be able to store the hand-held tool in a forward leaning position, which is a position where a rear end portion of the tool main body extends obliquely upward from a seat portion, and the toolbox comprises:

a toolbox main body constructed to receive the at least one hand-held tool; and a lid constructed to be able to open and close the toolbox main body; and a support member disposed within the toolbox main body, wherein the support member comprises:

at least one first support portion for supporting the front end portion of the tool main body;

at least one second support portion for supporting the rear end portion of the handle portion; and an intermediate portion positioned between the first and second support portions and configured not to contact with the hand-held tool, wherein the lid can be closed while the at least one hand-held tool is received within the toolbox main body in the forward leaning position;

wherein the lid is coupled to the toolbox main body via a hinge portion, so that the lid can pivot upwardly and downwardly for opening and closing the tool main body, and the forward leaning position is angled toward the hinge portion;

wherein the at least one hand-held tool includes a battery pack attached to at least one of the tool main body and the handle portion;

wherein the toolbox main body is configured to be able to store the at least one hand-held tool with the battery pack attached thereto; and wherein the at least one first support portion includes an inclined support portion that is upwardly inclined toward a rear side of the toolbox, and a fitting concave portion to accommodate a front end of the hand-held tool.

2. The toolbox as defined in claim 1, wherein the toolbox main body is configured to be able to store a battery charger for charging power to the battery pack in addition to the at least one hand-held tool.

3. The toolbox as defined in claim 2, wherein two hand-held tools can be stored in the toolbox such that the hand-held tools are positioned on opposite sides of the battery charger.

4. The toolbox as defined in claim 3, wherein the hand-held tools are arranged parallel to each other and are spaced by a predetermined distance.

5. The toolbox as defined in claim 1, wherein:

each of the first and second support portions includes at least one of a recess and a concave.

6. The toolbox as defined in claim 5, wherein the hand-held tool further includes a spindle and a tool bit attached to the spindle; and the first support portion further includes a relief recess for preventing the tool bit from contacting with the support member.

7. The toolbox as defined in claim 1, wherein:

the tool main body has a body axis;

the handle has a handle axis;

the body axis and the handle axis are positioned substantially within a plane that extends vertically when the hand-held tool is stored within the toolbox.

8. A toolbox to store at least one hand-held tool comprising:

a toolbox main body having a seat portion, the seat portion having at least one front end support portion and at least one rear end support portion positioned a distance away from the at least one front end support portion, wherein the at least one front end support portion and the at least one rear end support portion are positioned at different heights so that when storing the hand-held tool, the hand-held tool is in a forward leaning posture, which is a posture where a rear end portion of the tool main body extends obliquely upward from a seat portion, wherein the at least at least one hand-held tool includes a battery pack attached to at least one of the tool main body and the handle portion;

wherein the toolbox main body is configured to be able to store the at least one hand-held tool with the battery pack attached thereto, and a lid constructed to be able to open and close the toolbox main body;

wherein the lid can be closed while the hand-held tool is received within the toolbox main body in the forward leaning posture, wherein the lid is coupled to the toolbox main body via a hinge portion, so that the lid can pivot upwardly and downwardly for opening and closing the tool main body, and the forward leaning posture is angled toward the hinge portion, and wherein the at least one front end support portion includes an inclined support portion that is upwardly inclined toward a rear side of the toolbox, and a fitting concave portion to accommodate a front end of the hand-held tool.

9. The toolbox of claim 8, wherein the at least one front end support portion has a greater height than the at least one rear end support portion.

10. The toolbox of claim 8, wherein the at least one rear end support portion includes a v-shaped supporting recess that is inclined deeper towards a front side of the toolbox.

11. The toolbox of claim 10, wherein the at least one rear end support portion further includes a fitting concave portion extending from the v-shaped supporting recess to a base of the toolbox.

12. The toolbox of claim 8, wherein the seat portion includes a relieving concave adjacent to the front end supporting portion defining a recess in the seat portion.

13. The toolbox of claim 8, wherein the seat portion includes a plurality of supporting holes adjacent to the front and rear end support portions, the plurality of supporting holes able to accommodate a battery charger.

14. The toolbox as defined in claim 1, wherein the at least one hand-held tool is supported by a support portion configured to provide vertical and lateral support for the at least one tool.

15. The toolbox as defined in claim 8, wherein at least one of the front-end support portion and the rear-end support portion is configured to provide vertical and lateral support for the hand-held tool.

16. A toolbox for storing at least one hand-held tool, comprising:

a tool main body and a handle portion extending from a side portion of the tool main body, wherein the toolbox is constructed to be able to store the hand-held tool in a forward leaning position, which is a position where a rear end portion of the tool main body extends obliquely upward from a seat portion, and the toolbox comprises:

a toolbox main body constructed to receive the at least one hand-held tool; and a lid constructed to be able to open and close the toolbox main body; and a support member disposed within the toolbox main body, wherein the support member comprises:

at least one first support portion for supporting the front end portion of the tool main body;

at least one second support portion for supporting the rear end portion of the handle portion; and an intermediate portion positioned between the first and second support portions and configured not to contact with the hand-held tool, wherein the lid can be closed while the at least one hand-held tool is received within the toolbox main body in the forward leaning position;

wherein the lid is coupled to the toolbox main body via a hinge portion, so that the lid can pivot upwardly and downwardly for opening and closing the tool main body, and the forward leaning position is angled toward the hinge portion;

wherein the at least one hand-held tool includes a battery pack attached to at least one of the tool main body and the handle portion;

wherein the toolbox main body is configured to be able to store the at least one hand-held tool with the battery pack attached thereto;

wherein the at least one first support portion includes an inclined support portion that is upwardly inclined toward a rear side of the toolbox, and a fitting concave portion to accommodate a front end of the hand-held tool;

wherein the at least one second support portion includes a v-shaped supporting recess that is inclined deeper towards a front side of the toolbox;

wherein the at least one second support portion further includes a fitting concave portion extending from the v-shaped supporting recess to a base of the toolbox; and wherein the seat portion includes a relieving concave adjacent to the first supporting portion, and defining a recess in the seat portion.

* * * * *